US005443173A

United States Patent [19]

Emery et al.

[11] Patent Number: 5,443,173

[45] Date of Patent: Aug. 22, 1995

[54] COLLAPSIBLE BASKET

[75] Inventors: William W. Emery, Berkeley Heights; Russell A. Fritts, Warren, both of N.J.

[73] Assignee: Better Sleep Mfg. Co., Berkeley Heights, N.J.

[21] Appl. No.: 292,099

[22] Filed: Aug. 17, 1994

[51] Int. Cl.[6] ..... B65D 6/12

[52] U.S. Cl. ..... 220/6; 220/481; 220/485; 220/494

[58] Field of Search ..... 220/4.28, 6, 7, 480, 220/481, 485, 494

[56] References Cited

U.S. PATENT DOCUMENTS

| | | | |
|---|---|---|---|
| 323,339 | 7/1885 | Kilborn | 220/485 X |
| 610,854 | 9/1898 | Arrick | 220/485 X |
| 1,284,579 | 11/1918 | Brown | 220/485 |
| 2,812,875 | 11/1957 | Buzicky et al. | 220/481 X |
| 2,985,332 | 5/1961 | Fredrick | 220/6 |
| 2,994,441 | 8/1961 | Browning, Jr. | 220/485 X |
| 3,378,161 | 4/1968 | Lookabaugh | 220/6 |
| 3,890,932 | 6/1975 | Sanzone et al. . | |
| 4,015,743 | 4/1977 | Beretta . | |
| 4,313,634 | 2/1982 | Williams . | |
| 4,620,319 | 10/1986 | Sheehan et al. . | |
| 4,832,222 | 5/1989 | Storton . | |

*Primary Examiner*—Allan N. Shoap
*Assistant Examiner*—Stephen Cronin
*Attorney, Agent, or Firm*—Hopgood, Calimafde, Kalil & Judlowe

[57] ABSTRACT

The disclosed invention is directed to wall-mounted baskets which are easily collapsible for cost effective transportation and which are assembled with ease by the end-user. The devices are characterized by unique, yet simple locking mechanisms permitting individual pieces of the basket to combine to form a stable receptacle with superior structural integrity.

5 Claims, 4 Drawing Sheets

COLLAPSIBLE BASKET

FIELD OF INVENTION

The present invention relates to wire frame storage structures for mounting onto vertical surfaces. More particularly, the invention is a utility basket having a unique, collapsible locking mechanism for easy storage, transportation and reassembly.

BACKGROUND OF THE INVENTION

Organizing devices for mounting to vertical surfaces such as walls, doors or other vertical structures are known. Such wall or door organizing devices are solid, one piece units in the form of coated steel wire structures having a frame which is mounted to a vertical surface with suction cups. The single piece units are costly to transport, difficult to handle and require excessive storage and retail space.

Attempts have been made to produce "knocked down" or collapsible versions of over-the-door organizers. Generally, coated steel wire shelves are supported by vertical, metal tubing frame members which have holes drilled or punched through their sides. The holes permit ends of the steel wire to be inserted through the tubing, after which the ends are capped with formed metal nuts. Such joints are cheap and easy to manufacture, but are unstable no matter how tight the nuts are fastened and the resulting assembly has poor structural integrity.

Collapsible, metal wire containers for making storage racks are known. For example, Beretta Patent No. 4,015,743 describes a basket which is purported to be foldable into stacks. However, such containers are not suitable for wall mounting.

There is a need in the art for a wall or door mounted utility basket which is collapsible for cost-effective shipping, storage and display, and which has structural elements which contribute to a locking mechanism for ease in assembly and for providing rigid support once assembled.

OBJECTS OF THE INVENTION

It is an object of the present invention to provide a basket organizer which is collapsible for cost-effective shipping, storage and display.

Another object of the present invention is to provide a collapsible basket with a novel locking mechanism for superior, overall structural integrity upon assembly.

Another object is to provide a collapsible basket which is transportable in knocked down form for reduced cost shipping, storage and display, and which has structural elements which contribute to a unique locking mechanism for ease in assembly and for providing rigid support once assembled.

These and other objects will be apparent from the present disclosure.

SUMMARY OF THE INVENTION

In the preferred embodiment, the collapsible basket is constructed from coated metal wire and is comprised of at least four separate sections. The sections include a base member, two side wall pieces and a front wall piece.

The four collapsed sections are assembled by attaching the two side walls laterally to either side of the front wall using one embodiment of the locking means described herein. The rear portions of the base member are hingedly attached to the bottom edges of the two side walls, and the base member serves as the floor of the assembled basket when it is engaged to the front wall using another embodiment of the invention's locking means. The base member functions also as a downwardly opening trap door when it is disengaged from the front wall.

Specifically, the basket of collapsible construction for attachment to substantially vertical surfaces such as walls or doors comprises four individual members capable of being inter-lockedly assembled to form the basket. The members include three substantially rectangular walls including a front wall, a left wall, and a right wall. The walls are capable of being assembled to form a bounded region having a four-sided cross-section when placed against a substantially vertical structure, with each of the walls having at least two parallel center rods and at least two parallel outer rods.

The front wall has a locking mechanism comprising a structural member of upward facing concavity formed as an extension of both the center rods of the front wall. The right wall comprises an upper left edge, an upper right edge, a lower left edge, a lower right edge, an upper hook extending from the upper left edge, a lower hook extending from the lower left edge, an upper mounting tip extending upwardly from the upper right edge, a lower mounting tip extending downwardly from the lower right edge, and a loop formed by extending the right end rod downwardly and horizontally to terminate proximate the lower mounting tip, thereby forming a right aperture.

The left wall comprises an upper left edge, an upper right edge, a lower left edge, a lower right edge, an upper hook extending from the upper right edge, a lower hook extending from the lower right edge, an upper mounting tip extending upwardly from the upper left edge, a lower mounting tip extending downwardly from the lower left edge, and a loop formed by extending the left end rod downwardly and horizontally to terminate proximate the lower mounting tip, thereby forming a left aperture.

Also provided is a four-sided base disposed within the cross-section formed by the three walls, the base comprising a front arm, a left arm forming an angle with the front arm, a rear arm forming an angle with the left arm and extending substantially parallel to the front arm, a right arm forming an angle with the rear arm and another angle with the front arm, a rear sliding pivot mechanism comprising a left end portion extending from the left arm, a right end portion extending from the right arm, the end portions being adapted for passage through a sliding engagement with the left aperture and the right aperture.

The base also has a front locking mechanism comprising a structural member of downward facing concavity formed as an extension of the left arm and the right arm forwardly, downwardly, and toward each other until the two extensions meet at a position below the plane of the rods.

The assembled basket is mounted to a substantially vertical surface using suitable attachment means well known to those skilled in this art such as suction cups, pressure sensitive tapes, screws or hooks. Once mounted, the basket forms a receptacle having an open top with the mounting surface acting as another wall. The design of the assembled basket with its unique locking means provides rigid, overall structural integrity before and after it is mounted onto a substantially vertical surface.

BRIEF DESCRIPTION OF THE DRAWINGS

For a more complete understanding of this invention, reference is made to the following detailed description of the preferred embodiment in connection with the accompanying drawings.

DETAILED DESCRIPTION OF THE PREFERRED EMBODIMENT

Figure 1:
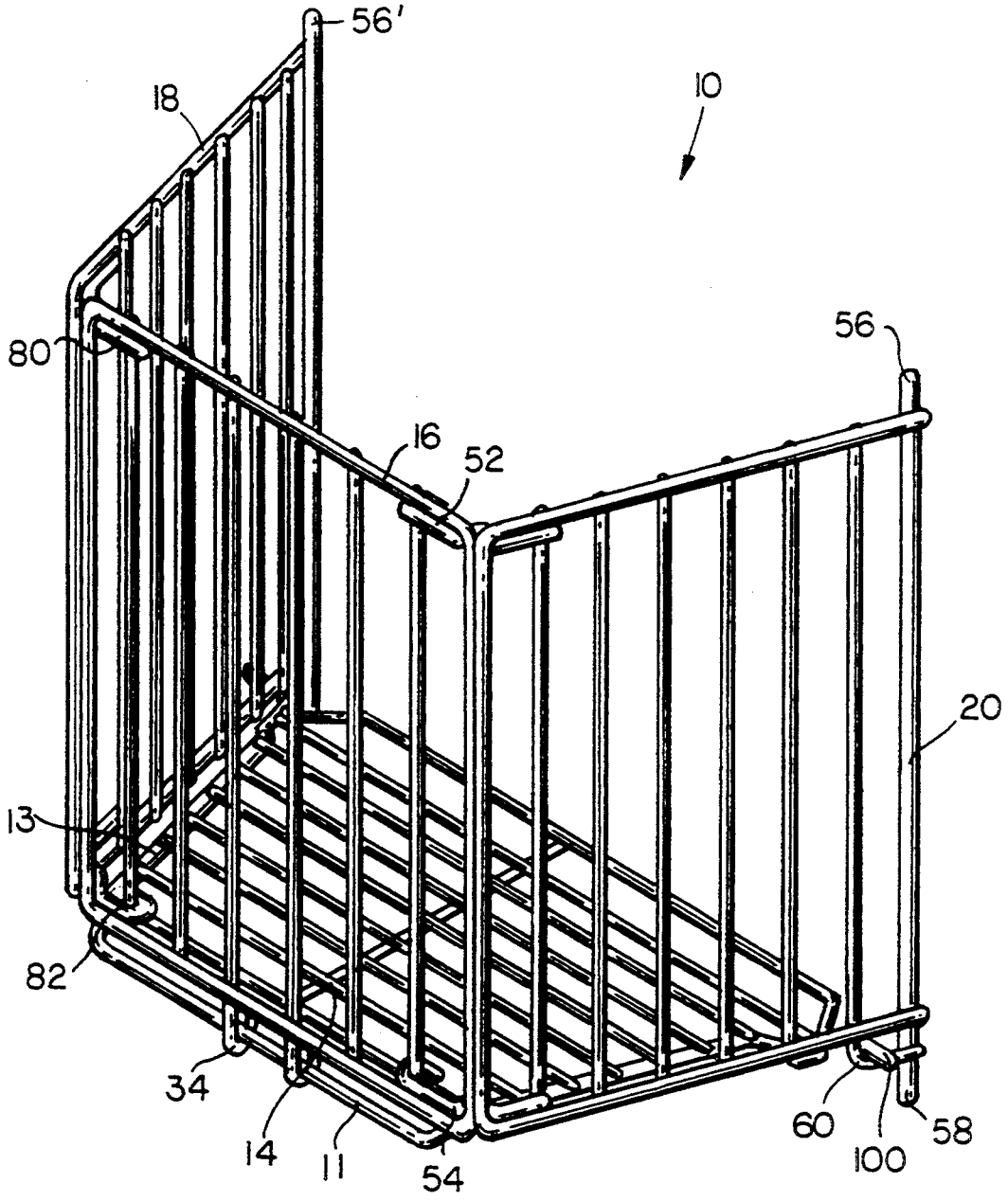
FIG. 1 is a perspective view of the assembled basket showing the preferred embodiment of the present invention.

FIG. 1 depicts the preferred embodiment of the present invention showing an assembled basket generally designated 10. Basket 10 comprises a base member 14, left side wall 18, right side wall 20 and front wall 16. Left side wall 18, right side wall 20 and front wall 16 are substantially perpendicular to base 14. The preferred embodiment is constructed principally of coated steel wire, but one skilled in the art can readily appreciate the vast variety of other possible substitute materials suitable for such construction, especially after a review of this disclosure. For example, such alternate materials could include molded plastic or plated wire.

Figure 2:
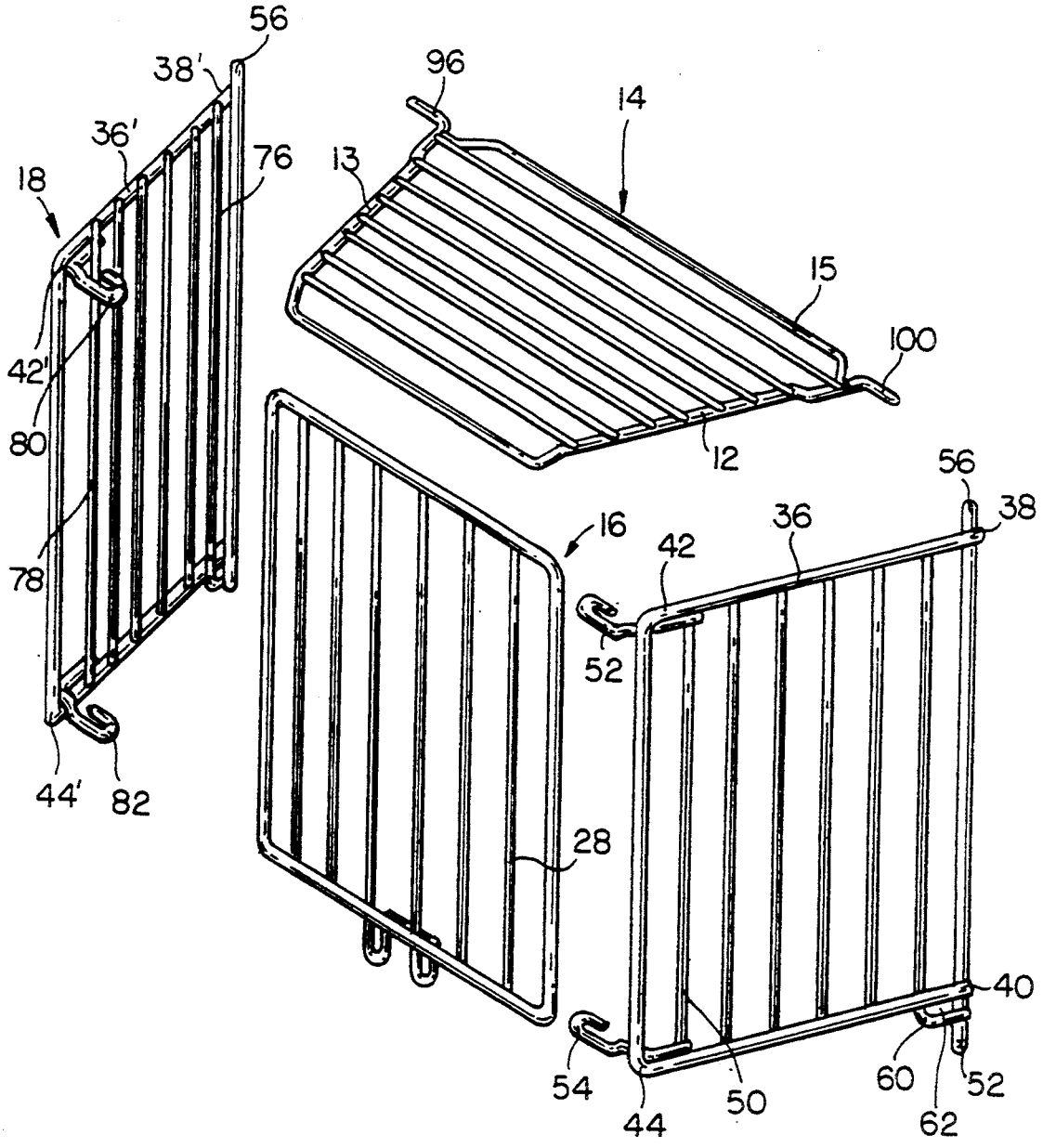
FIG. 2 shows the four main components that make up the preferred embodiment collapsible basket shown in FIG. 1.

FIG. 2 shows that front wall 16 comprises a plurality of substantially vertical front wall rods, including rods 26, 28, 30 and 33, which are attachably disposed within a substantially rectangular frame 22. Front wall 16 further comprises a front wall lip 34 which is shown as an upwardly facing concavity which connects lower extensions of rods 26 and 30.

Right side wall 20 comprises a plurality of substantially vertical right wall rods, including rods 48 and 50, which are attachably disposed within a substantially rectangular right frame member 36. Frame member 36 includes an upper right edge 38, a lower right edge 40, an upper left edge 42 and a lower left edge 44. Right side wall 20 further comprises an upper right hook 52 located adjacent upper left edge 42 and a lower hook 54 located adjacent lower left edge 44. An upper mounting tip 56 extends upwards from the right edge of right wall 20 adjacent upper right edge 38 and a lower mounting tip 58 extends downwards from the right edge of right wall 20 adjacent lower right edge 40. A right loop 60 is formed from a downward extension of rod 48 which terminates horizontally on the right edge of right side wall 20, thereby forming a right aperture 62.

Left side wall 18 comprises a plurality of substantially vertical right wall rods, including rods 76 and 78, which are attachably disposed within a substantially rectangular left frame member 36'. Left frame member 36' includes an upper right edge 38', a lower right edge 40', an upper left edge 42' and a lower left edge 44'. Left side wall 18 further comprises an upper left hook 80 located adjacent upper left edge 42' and a lower left hook 82 located adjacent lower left edge 44'. An upper mounting tip 56' extends upwards from the right edge of left wall 18 adjacent upper right edge 38' and a lower mounting tip 58' extends downwards from the right edge of left wall 18 adjacent lower right edge 40'. A left loop 88 is formed from a downward extension of rod 76 which terminates horizontally on the left edge of left side wall 18, thereby forming left aperture 90.

FIG. 2 includes a depiction of base member 14 which has a front edge 11, left edge 13, right edge 12 and rear edge 15. Extending laterally from either side of rear edge 15 are left arm 96 and right arm 100. To assemble collapsible basket 10, left side wall 18 is attached to front wall 16 by initially inserting hooks 80 and 82 from a position behind wall 16 through the free space between rod 33 and frame 22.

Figure 4:
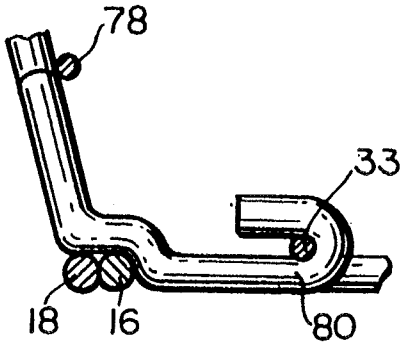
FIG. 4 depicts an isolated, partially cut-away, top view of the preferred locking mechanism seen from line 4—4 in FIG. 3.

Referring to FIG. 4 by way of example, hook 80 engages rod 33 (shown in cross-section) while anchoring firmly onto the left edge of front wall 16 (shown in cross-section). Likewise, hook 82 engages rod 33 while anchoring firmly onto the left edge of front wall 16, and hooks 52 and 54 engage rod 28 on front wall 16 while anchoring firmly onto the right edge of front wall 16.

Figure 5:
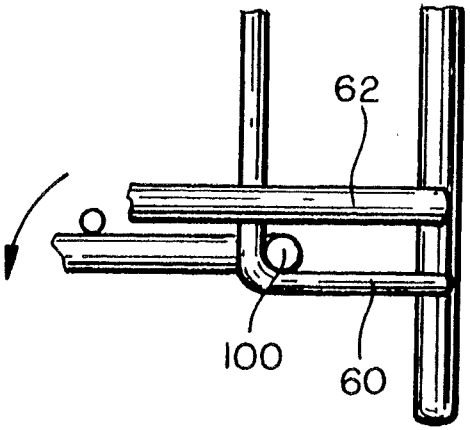
FIG. 5 is an isolated side view showing a hinge connection between a base member and a side wall.
Figure 3:
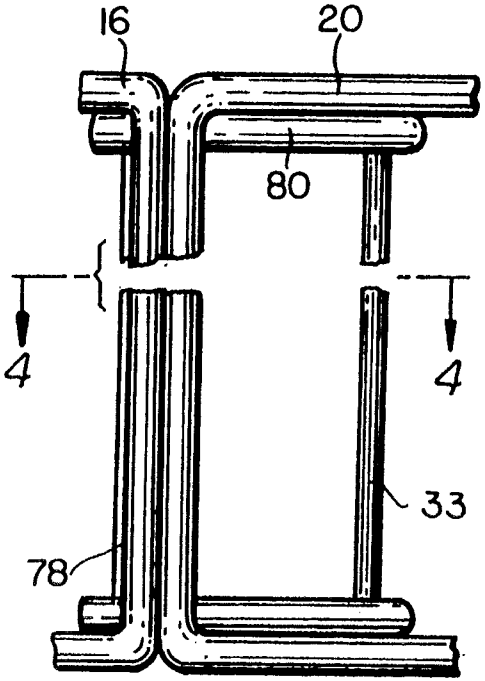
FIG. 3 is an isolated front view showing engagement of the left edge of a front wall member with the right edge of a left sidewall member.

To complete assembly, the left edge of right side wall 20 engages the right edge of front wall 16 (see FIG. 3) and the bottom edge of right side wall 20 aligns with right edge 12 of base 14. Right arm 100 extends through aperture 62 and rests on right loop 60 (see FIG. 5), and left arm 96 extends through aperture 90 and rests on left loop 88.

Referring to FIG. 1, front edge 11 of horizontal base member 14 rests on front wall lip 34 of vertical front wall 16, the left edge of front wall 16 engages the right edge of left side wall 18, and the bottom edge of left side wall 18 aligns with left edge 13 of base 14. In this configuration, base 14 acts as the floor of basket 10 depicted in FIG. 6, which thereby delineates a receptacle having an open top defined by three vertical walls 16, 18 and 20 with the mounting surface acting as the fourth wall.

Figure 6:
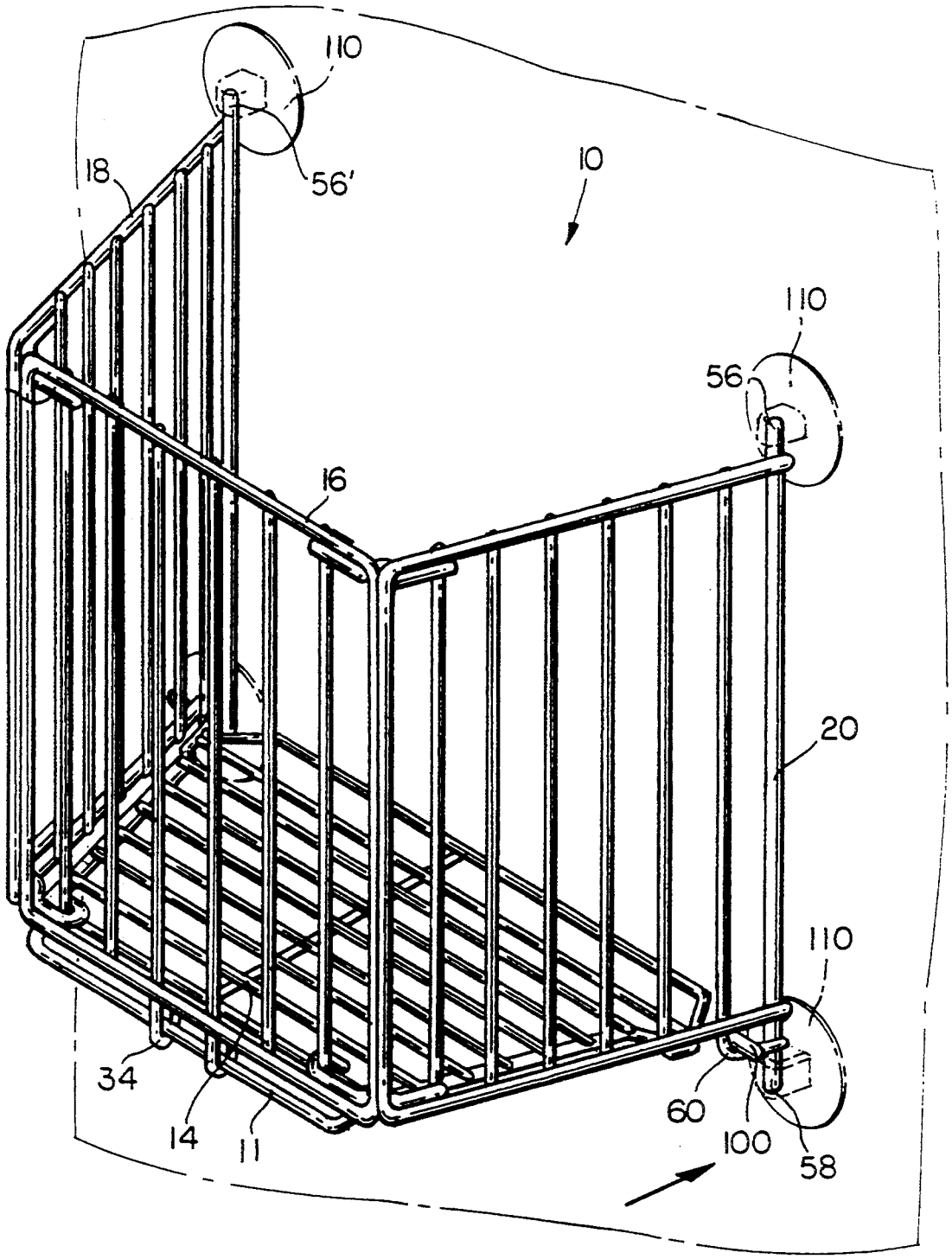
FIG. 6 depicts the assembled basket mounted to a portion of a vertical surface using suction cups.

When front edge 11 of horizontal base 14 is disengaged from lip 34 of vertical front wall 16, right arm 100 and left arm 96 are able to travel along right loop 60 and left loop 88, respectively, in a direction indicated with arrows in FIG. 6. The pull of gravity swings front edge 11 in a downward, rotational direction, with arms 100 and 96 acting as fulcrums (see arrow depicted in FIG. 5). In this configuration, base 14 acts as an open trap door to allow articles stored in the receptacle to gently fall out.

In the preferred embodiment, frame support elements are provided for attachment of basket 10 to a substantially vertical surface. Referring to FIG. 6, mounting tips 56, 56', 58 and 58' are shown positioned in suction cups 110. Although suction cups have been described as part of the preferred frame support elements, those skilled in the art can readily discern that other attaching devices are feasible such as screws or adhesive materials.

The illustrated preferred embodiment has proven to be useful as a collapsible basket providing a receptacle once mounted to a substantially vertical surface. Further modifications based on the disclosure will occur to persons skilled in the art. Such modifications are within the scope and spirit of the present invention as defined by the following claims.

What is claimed is:

1. A basket of collapsible construction for attachment to substantially vertical surfaces, said basket comprising:

four individual members capable of being interlockedly assembled to form said basket, said members including three substantially rectangular walls including a front wall, a left wall, and a right wall, said walls capable of being assembled to form a bounded region having a four-sided cross-section when placed against a substantially vertical structure, each of said walls having at least two parallel center rods and at least two parallel outer rods;

said front wall having a locking mechanism comprising a structural member of upward facing concavity formed as an extension of both said center rods of said front wall;

said right wall comprising an upper left edge, an upper right edge, a lower left edge, a lower right edge, an upper hook extending from said upper left edge, a lower hook extending from said lower left edge, an upper mounting tip extending upwardly from said upper right edge, a lower mounting tip extending downwardly from said lower right edge, a loop formed by extending the right end rod downwardly and horizontally to terminate proximate said lower mounting tip, thereby forming a right aperture;

said left wall comprising an upper left edge, an upper right edge, a lower left edge, a lower right edge, an upper hook extending from said upper right edge, a lower hook extending from said lower right edge, an upper mounting tip extending upwardly from said upper left edge, a lower mounting tip extending downwardly from said lower left edge, a loop formed by extending the left end rod downwardly and horizontally to terminate proximate said lower mounting tip, thereby forming a left aperture; and a four-sided base disposed within said cross-section formed by said three walls, said base comprising a front arm, a left arm forming an angle with said front arm, a rear arm forming an angle with said left arm and extending substantially parallel to said front arm, a right arm forming an angle with said rear arm and another angle with said front arm, a rear sliding pivot mechanism comprising a left end portion extending from said left arm, a right end portion extending from said right arm, said end portions being adapted for passage through a sliding engagement with said left aperture and said right aperture, a front locking mechanism comprising a structural member of downward facing concavity formed as an extension of said left arm and said right arm forwardly, downwardly, and toward each other until said two extensions meet at a position below the plane of said rods.

2. The basket of claim 1, wherein said four individual members are comprised of a material selected from the group consisting of coated steel wire, molded plastic and plated wire.

3. The basket of claim 1, wherein said base has a center rod linking said rear arm and said front arm at their respective substantial centers and a plurality of parallel rods situated perpendicularly to said center rod and linking said right arm with said left arm.

4. The basket of claim 1, wherein said base is substantially trapezoidal, with said left arm forming an obtuse angle with said front arm, said rear arm forming an acute angle with said left arm and extending parallel to said front arm, said right arm forming an acute angle with said rear arm and an obtuse angle with said front arm.

5. The basket of claim 1, wherein said cross-section formed by said three walls is substantially trapezoidal, with said left wall forming an obtuse angle with said front wall, and said right wall forming an obtuse angle with said front wall.

* * * * *